US006351879B1

(12) United States Patent
Furlani et al.

(10) Patent No.: US 6,351,879 B1
(45) **Date of Patent: *Mar. 5, 2002**

(54) METHOD OF MAKING A PRINTING APPARATUS

(75) Inventors: Edward P. Furlani, Lancaster; Syamal K. Ghosh; Dilip K. Chatterjee, both of Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/143,770

(22) Filed: Aug. 31, 1998

(51) Int. Cl.[7] ..... H04R 17/00; H04R 17/10

(52) U.S. Cl. ..... 29/25.35; 29/890.1; 347/70; 347/68; 347/40; 427/100

(58) Field of Search ..... 347/66, 68, 85, 347/40, 70; 29/25.35, 890.1; 427/100; 252/62.9 PZ

(56) References Cited

U.S. PATENT DOCUMENTS 4,032,929 A * 6/1977 Fischbeck et al. ..... 347/40
4,227,111 A * 10/1980 Cross et al. ..... 29/25.35
4,355,256 A * 10/1982 Perduijn et al. ..... 252/62.9 PZ
4,422,003 A * 12/1983 Safari et al. ..... 252/62.9 PZ
4,521,322 A * 6/1985 Broussoux et al. ... 252/62.9 PZ
4,672,398 A * 6/1987 Kuwabara et al. ..... 347/66
4,842,493 A * 6/1989 Nilsson ..... 347/68
5,265,315 A * 11/1993 Hoisington et al. ..... 29/25.35
5,371,529 A * 12/1994 Eguchi et al. ..... 347/68
5,666,141 A * 9/1997 Matoba et al. ..... 347/68
5,757,396 A * 5/1998 Bruner ..... 347/68
5,767,878 A * 6/1998 Murphy ..... 347/68
5,812,163 A * 9/1998 Wong ..... 347/68
5,917,508 A * 6/1999 Lopez et al. ..... 347/66

FOREIGN PATENT DOCUMENTS

JP 55-142668 * 11/1980 ..... 347/70

* cited by examiner

*Primary Examiner*—Lee Young
*Assistant Examiner*—A. Dexter Tugbang
(74) *Attorney, Agent, or Firm*—Clyde E. Bailey, Sr.

(57) ABSTRACT

A method of making a printing apparatus configured for drawing fluid from a fluid reservoir and then ejecting droplets of fluid onto a receiver to form an image include the steps of providing an orifice manifold having a plurality of orifices each one of which in fluid communications with one of a plurality of piezoelectric pumps.

6 Claims, 5 Drawing Sheets

METHOD OF MAKING A PRINTING APPARATUS

CROSS REFERENCE TO RELATED APPLICATIONS

This application is related to commonly owned U.S. Pat. No. 5,900,271 May 4, 1999, entitled CONTROLLED COMPOSITION AND CRYSTALLOGRAPHIC CHANGES IN FORMING FUNCTIONALLY GRADIENT PIEZOELECTRIC TRANSDUCERS, by Dilip K. Chatteijee, Syamal K. Ghosh, and Edward P. Furlani.

FIELD OF THE INVENTION

The invention relates generally to the field of printing and, more particularly, to a method of making a printing apparatus that utilizes pumps having piezoelectric transducers with functionally gradient activation elements.

BACKGROUND OF THE INVENTION

Piezoelectric pumping mechanisms are widely used for ink flow and drop ejection in a variety of ink jet printing apparatus. Conventional piezoelectric pumps utilize piezoelectric transducers that comprise one or more uniformly polarized piezoelectric elements with attached surface electrodes. The three most common transducer configurations are multilayer ceramic, monomorph or bimorphs, and flextensional composite transducers. To activate a transducer, a voltage is applied across its electrodes thereby creating an electric field throughout the piezoelectric elements. This field induces a change in the geometry of the piezoelectric elements resulting in elongation, contraction, shear or combinations thereof. The induced geometric distortion of the elements can be used to implement motion or perform work. In particular, piezoelectric bimorph transducers, which produces a bending motion, are commonly used in micropumping devices. However, a drawback of the conventional piezoelectric bimorph transducers is that two bonded piezoelectric elements are needed to implement the bending. These bimorph transducers are difficult and costly to manufacture for micropumping applications (in this application, the word micro means that the dimensions of the apparatus range from 100 microns to 10 mm). Also, when multiple bonded elements are used, stress induced in the elements due to their constrained motion can damage or fracture an element due to abrupt changes in material properties and strain at material interfaces.

Therefore, a need persists for a method of making a printing apparatus that provides for a plurality of independent piezoelectric pumps each utilizing a functionally gradient piezoelectric transducer that overcomes the aforementioned problems associated with conventional pumping apparatus.

SUMMARY OF THE INVENTION

It is, therefore, an object of the present invention to provide a method of making a printing apparatus which includes a plurality of piezoelectric pumps each of which utilizes a transducer in which the pumping action is accomplished with a single functionally gradient piezoelectric element.

To accomplish these and other objects an advantages of the invention, there is provided a method of making a printing apparatus configured for drawing fluid from a fluid reservoir and then ejecting droplets of fluid onto a receiver to form an image, comprising the steps of:

(a) providing an orifice manifold having a plurality of spaced orifices through which droplets of fluid are ejected;

(b) providing a plurality of adjoining independent piezoelectric pumps, each having an inlet port and an outlet port, said piezoelectric pumps comprising a pump body having an interior fluid compartment, and means for controlling fluid passing through said inlet and outlet ports;

(c) arranging each one of said plurality of piezoelectric pumps so that an outlet port is in fluid communications with one of said spaced orifices of said manifold;

(d) arranging a piezoelectric transducer in said pump of each one of said plurality of piezoelectric pumps, each one of said piezoelectric transducers comprising a functionally gradient piezoelectric element having opposed first and second surfaces and a first electrode fixedly arranged on said first surface and a second electrode fixedly arranged on said second surface, said piezoelectric element being formed of piezoelectric material having a functionally gradient dcoefficient selected so that the functionally gradient piezoelectric element changes geometry in response to an applied voltage to said first and second electrodes which produces an electric field in the functionally gradient piezoelectric element;

(e) providing a plurality of power sources, each having first and second terminals connected respectively to said first and second electrodes of each one of said piezoelectric transducers for enabling fluid flow through a respective fluid reservoir;

(f) operably connecting each one of said plurality of power sources to one of said plurality of piezoelectric pumps;

(g) energizing any one of said piezoelectric transducers to pump fluid from said fluid reservoir then through said inlet port of said interior fluid compartment in at least one of said pumps and then through said orifice in fluid communications therewith of said orifice manifold thereby forming an ejected droplet of fluid; and (h) positioning the receiver in proximity to said orifice manifold for receiving said ejected droplet of fluid so as to form an image thereon.

Accordingly, an advantageous effect of the method of the invention is that it utilizes pumps that implement fluid motion with the use of a single functionally gradient piezoelectric thereby eliminating the need for multilayered or composite piezoelectric structures. This eliminates the need for multiple electrodes and associated drive electronics; and it minimizes or eliminates stress induced fracturing that occurs in multilayered or composite piezoelectric structures.

BRIEF DESCRIPTION OF THE DRAWINGS

The above and objects, features and advantages of the present invention will become apparent when taken in conjunction with the following description and drawings wherein identical reference numerals have been used, where possible, to designate identical features that are common to the figures, and wherein.

DETAILED DESCRIPTION OF THE INVENTION

Figure 1:
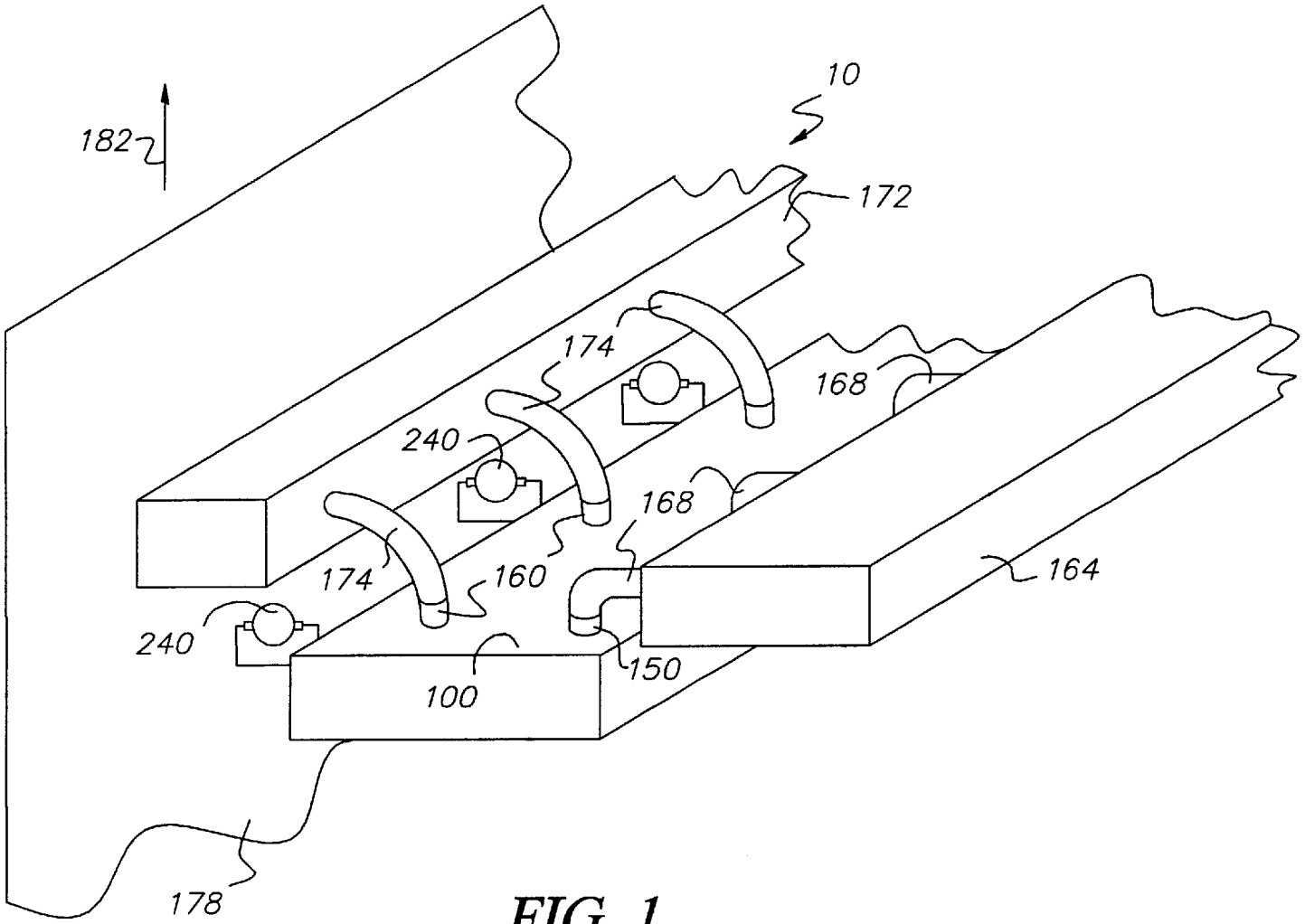
FIG. 1 is a perspective view of a partial section of the printing apparatus of the present invention.
Figure 2:
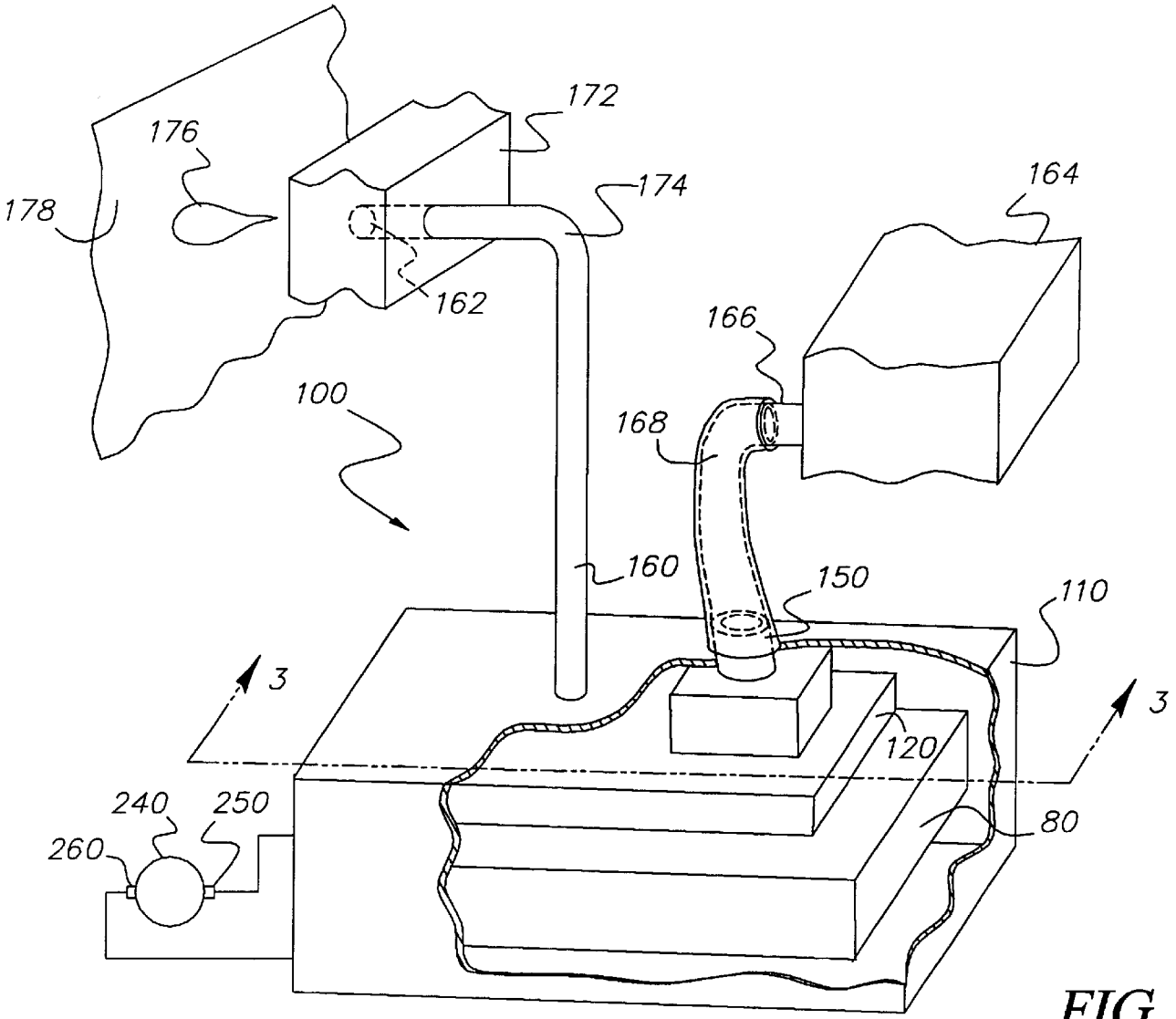
FIG. 2 is a perspective view of the piezoelectric pumping apparatus of the invention, partially torn away to expose the piezoelectric transducer.
Figure 3:
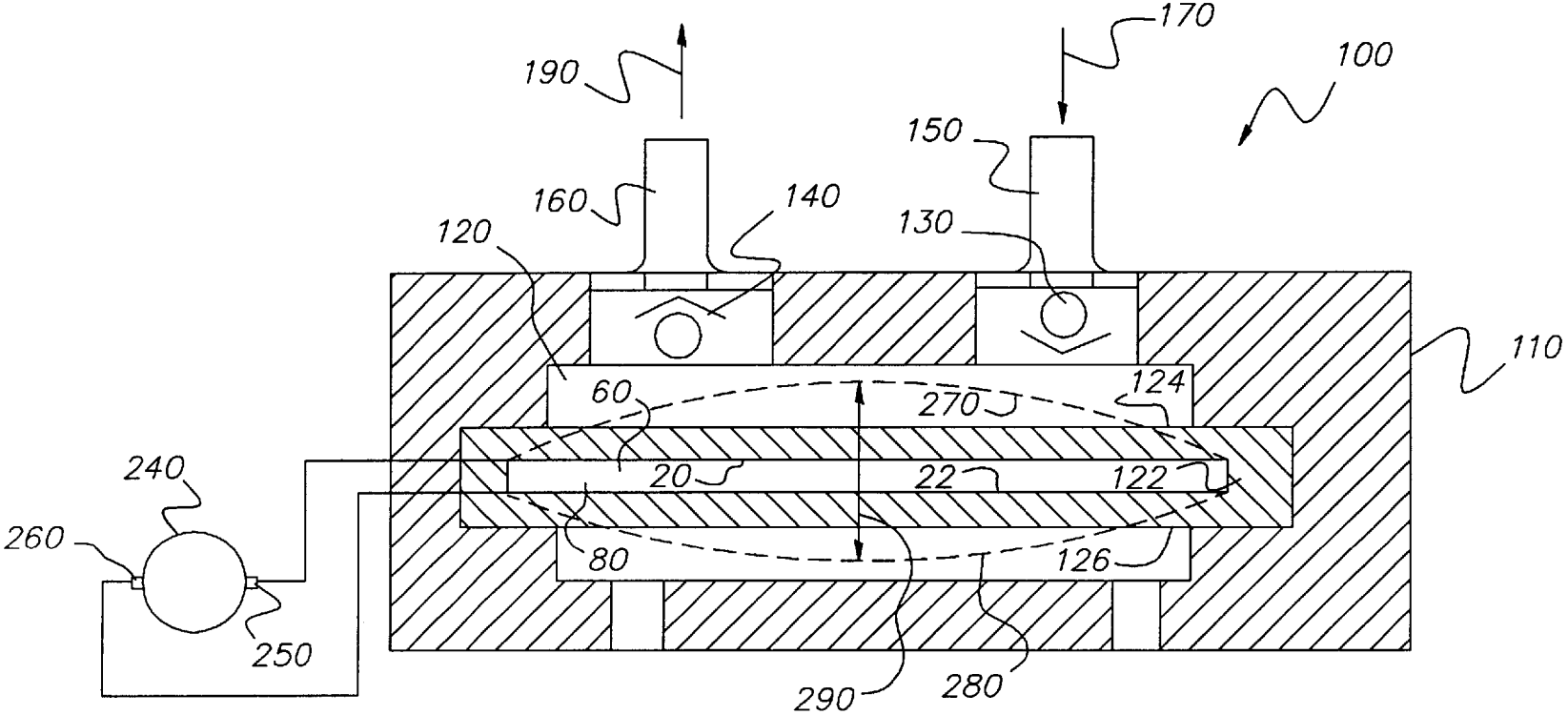
FIG. 3 is a section view along line 3—3 of FIG. 2.

Turning now to the drawings, and particularly to FIGS. 1, 2 and 3, the printing apparatus 10, such as an ink jet printer, of the present invention is shown. Referring to FIG. 1, a perspective view is shown of a partial section of printing apparatus 10. According to our invention, printing apparatus 10 comprises a plurality of piezoelectric pumping apparatus 100, an ink reservoir 164, an orifice manifold 172 having a plurality of orifices 162 (FIG. 2), and a receiver 178 for receiving ink thereon. The plurality of piezoelectric pumping apparatus 100 are arranged in fluid communication with the ink reservoir 164 and orifice manifold 172, as described below. In a preferred embodiment of the invention, printing apparatus 10 is configured for drawing ink from the ink reservoir 164 and then ejecting droplets of ink out of an orifice manifold 172 onto a receiver 178 to form an image (not shown).

As shown in FIGS. 1–3, a power source 240 is connected to each one of the plurality of functionally gradient piezoelectric pumping apparatus 100 for causing ink to flow from the ink reservoir 164 through the orifice manifold 172 and onto the receiver 178, described further below. As depicted in FIGS. 2 and 3, each piezoelectric pumping apparatus 100 has a pump body 110 with an interior fluid compartment 120 and an inlet port 150 and outlet port 160 in fluid communication with the interior fluid compartment 120. Inlet and outlet ports 150, 160 have a first valve 130 and a second value 140, respectively, for controlling fluids passing therethrough in directions as indicated by arrows 170, 190. As seen clearly in FIG. 2, piezoelectric transducer 80 is arranged in the pump body 110 for enabling fluid flow in and out of the interior fluid compartment 120. Piezoelectric transducer 80 is encapsulated in a compliant member 122 having a top surface 124 and a bottom surface 126 as shown. Compliant member 122 functions to insulate the transducer 80 from the ink in the interior fluid compartment 120.

According to FIG. 2, ink reservoir 164 has a plurality of outflow ports 166 which are connected via fluid conduits 168 to the inlet ports 150 for supplying fluid to the plurality of piezoelectric pumps 100. The outlet ports 160 are connected to respective orifices 162 in the orifice manifold 172 via conduits 174. During operation, ink is ejected from the orifice manifold 172 in the form of drops 176 that ultimately come to rest on the receiver 178 to form an image thereon as will be described. In this application, the word ink can include pigments, dyes or other colorants that can render pixels of an image on a receiver.

Figure 4:
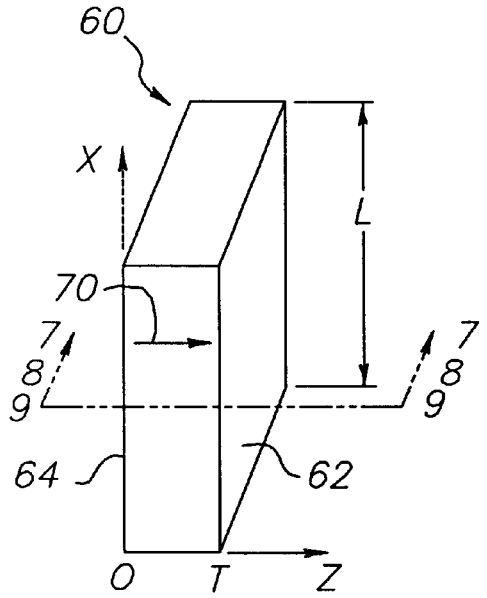
FIG. 4 a perspective view of a piezoelectric element with a functionally gradient $d_{31}$ coefficient.

Referring to FIG. 4, a perspective view is shown of a piezoelectric element 60 with a functionally gradient $d_{31}$ coefficient. Piezoelectric element 60 has first and second surfaces 62 and 64, respectively. The width of the piezoelectric element 60 is denoted by T and runs perpendicular to the first and second surfaces 62 and 64, respectively, as shown. The length of the piezoelectric element 60 is denoted by L and runs parallel to the first and second surfaces 62 and 64, respectively, as shown. Piezoelectric element 60 is poled perpendicularly to the first and second surfaces 62 and 64 as indicated by polarization vector 70.

Figure 5:
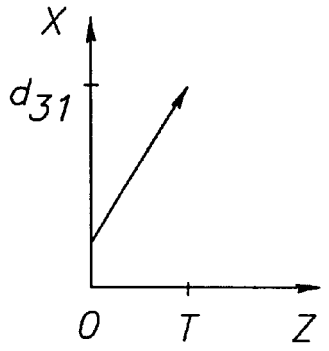
FIG. 5 is a plot of the piezoelectric $d_{31}$ coefficient across the width (T) of a piezoelectric transducer element of FIG. 4.
Figure 6:
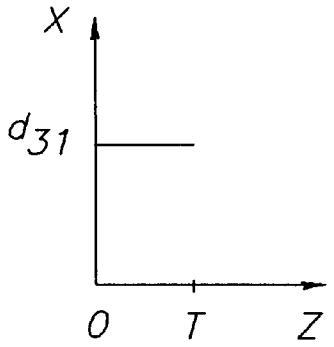
FIG. 6 is a plot of piezoelectric $d_{31}$ coefficient across the width (T) of a conventional piezoelectric bimorph transducer element, respectively.

Skilled artisans will appreciate that in conventional piezoelectric transducers the piezoelectric "d"-coefficients are constant throughout the piezoelectric element 60. Moreover, the magnitude of the induced sheer and strain are related to these "d"-coefficients via the constitutive relation as is well known. However, piezoelectric element 60 used in the pumping apparatus 100 of the invention is fabricated in a novel manner so that its piezoelectric properties vary in a prescribed fashion across its width as described below. The $d_{31}$ coefficient varies along a first direction perpendicular to the first surface 62 and the second surface 62, and decreases from the first surface 62 to the second surface 64, as shown in FIG. 5. This is in contrast to the uniform or constant spatial dependency of the $d_{31}$ coefficient in conventional piezoelectric elements, illustrated in FIG. 6

In order to form the preferred piezoelectric element 60 having a piezoelectric $d_{31}$ coefficient that varies in this fashion, the following method may be used. A piezoelectric block is coated with a first layer of piezoelectric material with a different composition than the block onto a surface of the block. Sequential coatings of one or more layers of piezoelectric material are then formed on the first layer and subsequent layers with different compositions of piezoelectric material. In this way, the piezoelectric element is formed which has a functionally gradient composition which varies along the length of the piezoelectric element, as shown in FIG. 5.

Preferably, piezoelectric materials for forming the piezoelectric $KNbO_3$ or $BaTiO_3$. Most preferred in this group is PZT. For a more detailed description of the method, see cross-referenced commonly assigned U.S. Patent Application Ser. No. 09/071,485, filed May 1, 1998, to Chatteijee et al, hereby incorporated herein by reference.

Figure 7:
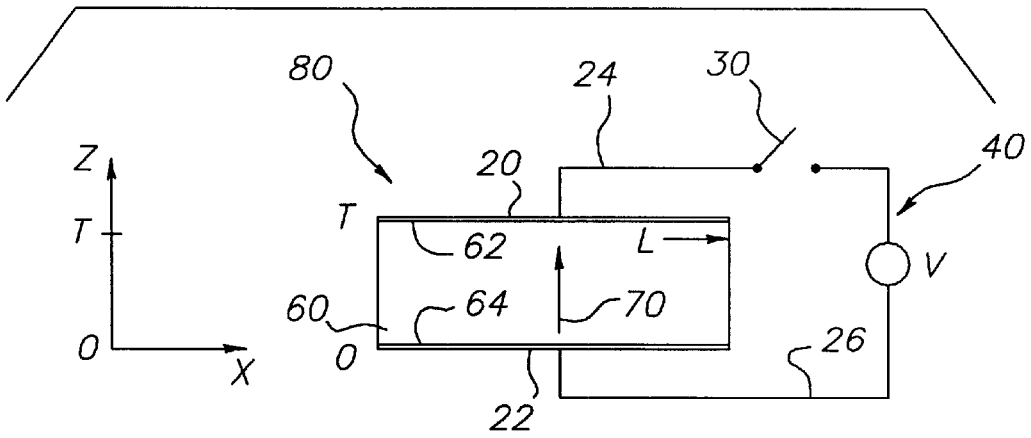
FIG. 7 is a section view along line 7—7 of FIG. 4 illustrating the piezoelectric transducer before activation.
Figure 8:
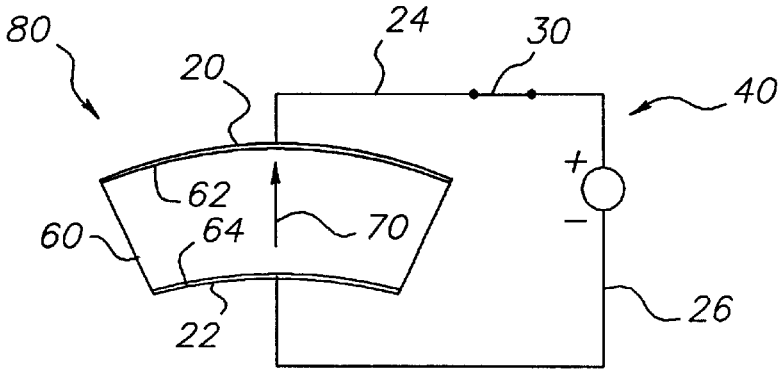
FIG. 8 is a section view taken along line 8—8 of FIG. 4 illustrating the piezoelectric transducer activation.
Figure 9:
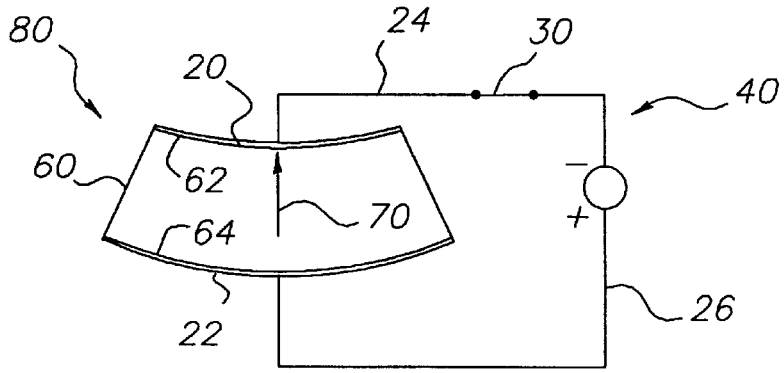
FIG. 9 is a section view taken along line 9—9 of FIG. 4 illustrating the piezoelectric transducer after activation but under a opposite polarity compared to FIG. 8.

Referring now to FIGS. 7,8 and 9, the piezoelectric transducer 80 is illustrated comprising piezoelectric element 60 in the inactivated state, a first bending state and a second bending state, respectively. Piezoelectric transducer 80 comprises piezoelectric element 60, with polarization vector 70, and first and second surface electrodes 20 and 22 attached to first and second surfaces 62 and 64, respectively. First and second surface electrodes 62 and 64 are connected to wires 24 and 26, respectively. Wire 24 is connected to a switch 30 that, in turn, is connected to a first terminal of voltage source 40. Wire 26 is connected to the second terminal of voltage source 40 as shown.

According to FIG. 7, the transducer 80 is shown with switch 30 open. Thus there is no voltage across the transducer 80 and it remains unactivated.

According to FIG. 8, the transducer 80 is shown with switch 30 closed. In this case, the voltage V of voltage source 40 is impressed across the transducer 80 with positive and negative terminals of the voltage source 40 electrically connected to the first and second surface electrodes 20 and 22, respectively. Thus, the first surface electrode 20 is at a higher potential than the second surface electrode 22. This potential difference creates an electric field through the piezoelectric element 60 causing it to expand in length parallel to its first and second surfaces 62 and 64, respectively and perpendicular to polarization vector 70. Specifically, we define S(z) to be the change in length (in this case expansion) in the x (parallel or lateral) direction noting that this expansion varies as a function of z. The thickness of the piezoelectric element is given by T as shown, and therefore $S(z)=(d_{31}(z)\ V/T)\times L$ as is well known. The functional dependence of the piezoelectric coefficient $d_{31}(z)$ increases with z as shown in FIG. 5. Thus, the lateral expansion S(z) of the piezoelectric element 60 decreases in magnitude from the first surface 62 to the second surface 64. Therefore, when a potential difference is impressed across the transducer 80 with the first surface electrode 20 at a higher potential than the second surface electrode 22, the transducer 80 distorts into a first bending state as shown.

Referring to FIG. 9, the transducer 80 is also shown with switch 30 closed. In this case, the voltage (V) of voltage source 40 is impressed across the transducer 80 with the negative and positive terminals of the voltage source 40 electrically connected to the first and second surface electrodes 20 and 22, respectively. Thus, the first surface electrode 20 is at a lower potential than the second surface electrode 22. As before, this potential difference creates an electric field through the piezoelectric element 60 causing it to contract in length parallel to its first and second surfaces 62 and 64, respectively and perpendicular to polarization vector 70. Specifically the change in length (in this case contraction) is given by $S(z)=-(d_{31}(z)\ V/T)\times L$ as is well known. Since the functional dependence of the piezoelectric coefficient $d_{31}(z)$ increases with z as shown in FIG. 5, the lateral contraction S(z) of the piezoelectric element 60 decreases in magnitude from the first surface 62 to the second surface 64. Therefore, when a potential difference is impressed across the transducer 80 with the first surface electrode 20 at a lower potential than the second surface electrode 22, the transducer 80 distorts into a second bending state as shown. It is important to note that the piezoelectric transducer 80 requires only one piezoelectric element 60 as compared to two or more elements for the prior art bimorph transducer (not shown).

The operation of printing apparatus 10 of the invention is now described with reference to FIGS. 1, 2, 3, 8 and 9. As indicated above, printing apparatus 10 is configured for drawing ink from the ink reservoir 164 and then ejecting droplets of ink out of an orifice manifold 172 onto a receiver 178 to form an image (not shown). Consequently, to pump ink from one of the plurality of piezoelectric pumps 100 onto the receiver 178 the respective power source 240 provides a positive voltage to the first terminal 250 and a negative voltage to the second terminal 260. In this case, first surface electrode 20 of the respective piezoelectric transducer 80 is at a higher potential than the second surface electrode 22. This creates an electric field through the piezoelectric element 60 causing it to expand in length parallel to the first and second surface electrodes 20 and 22, as discussed above. Since the functional dependence of the piezoelectric coefficient $d_{31}(z)$ increases with (z) as shown in FIG. 5, the lateral expansion of the piezoelectric element 60 decreases in magnitude from the first surface electrode 20 to the second electrode 22, thereby causing the piezoelectric transducer 80 to deform into a first bending state as shown in FIG. 8. Thus, the top surface 124 of compliant member 122 takes the shape of dotted line 270 thereby reducing the volume of the interior fluid compartment 120 (FIG. 3). This effect increases the pressure of the ink in the interior fluid compartment 120 and causes valve 140 to open. When valve 140 opens, ink then flows out of the interior fluid compartment 120 through the outlet port 160 and then out through the respective orifice 162 of orifice manifold 172 (FIG. 2) in the form of a drop 176. The ejected ink drop 176 ultimately impacts, and adheres to, the receiver 178 thereby forming a pigmented dot on the receiver 178.

An image (not shown) can be formed on the receiver 178 as receiver 178 moves relative to the orifice manifold 172 as indicated by arrow 182 (FIG. 1). Specifically, the image can be formed line by line via simultaneous activation of a select number of the plurality of power sources thereby causing the simultaneous ejection of ink drops out of the respective orifices 162 of orifice manifold 178 as described above. Thus a line of spaced dots is formed on the receiver 178 with subsequent lines being formed in a similar fashion until the desired image is completed as is well known.

To draw ink from the reservoir 164 into the interior fluid compartment 120 of any one of the plurality of piezoelectric pumps 100, the power source 240 connected to the respective piezoelectric pump 100 provides a negative voltage to terminal 250 and a positive voltage to terminal 260. In this case, first surface electrode 20 of the piezoelectric transducer 80 is at a lower potential than the second surface electrode 22. The potential difference created in the first and second electrodes 20, 22 produces an electric field through the piezoelectric element 60 causing it to contract in length parallel to the first and second surface electrodes 20 and 22, as discussed above. Since the functional dependence of the piezoelectric coefficient $d_{31}(z)$ increases with (z) (as shown in FIG. 5), the lateral contraction of the piezoelectric element 60 decreases in magnitude from the first surface electrode 20 to the second surface electrode 22, thereby causing the functionally gradient element 60 to deform into a second bending state as shown in FIG. 9. Thus, the bottom surface 126 (FIG. 3) of compliant member 122 takes the shape of dotted line 280 thereby reducing the volume of interior fluid compartment 120. This, in turn, decreases the pressure of the ink in the interior fluid compartment 120 causing valve 130 to open and ink to flow from the ink reservoir 164 into the interior fluid compartment 120 through the inlet port 150 as is well known.

With reference to FIG. 3, the outflow/inflow operation described above is depicted by the bidirectional arrow 290 that shows the range of motion of the compliant member 122 with enclosed piezoelectric transducer 80.

Therefore, the invention has been described with reference to a preferred embodiment. However, it will be appreciated that variations and modifications can be effected by a person of ordinary skill in the art without departing from the scope of the invention.

PARTS LIST 10 printing apparatus
20 first surface electrode
22 second surface electrode
24 wire
26 wire
30 switch
40 voltage source
60 piezoelectric element
62 first surface
64 second surface
70 polarization vector
80 piezoelectric transducer
100 piezoelectric pumping apparatus
110 pumpbody
120 interior fluid compartment 122 compliant member
124 top surface of compliant member
126 bottom surface of compliant member
130 first valve
140 second valve
150 inlet port
160 outlet port
162 orifice
164 reservoir
166 outflow port
168 ink conduit
170 flow arrow
172 orifice manifold
174 conduit
176 ink drop
178 receiver
182 arrow
190 flow arrow
240 power source
250 first terminal
260 second terminal
270 dotted line
280 dotted line
290 bi-directional arrow

What is claimed is:

1. Method of making a printing apparatus configured for drawing fluid from a fluid reservoir and then ejecting droplets of fluid onto a receiver to form an image, comprising the steps of:

(a) providing an orifice manifold having a plurality of spaced orifices through which droplets of fluid are ejected;

(b) providing a plurality of adjoining independent piezoelectric pumps, each having an inlet port and an outlet port, said piezoelectric pumps comprising a pump body having an interior fluid compartment, and means for controlling fluid passing through said inlet and outlet ports;

(c) arranging each one of said plurality of piezoelectric pumps so that an outlet port is in fluid communications with one of said spaced orifices of said manifold;

(d) arranging a piezoelectric transducer in said pump body of each one of said plurality of piezoelectric pumps, each one of said piezoelectric transducers comprising a functionally gradient piezoelectric element having opposed first and second surfaces and a first electrode fixedly arranged on said first surface and a second electrode fixedly arranged on said second surface, said piezoelectric element being formed of piezoelectric material having a functionally gradient d-coefficient formed from sequential coating layers of piezoelectric material selected so that the functionally gradient piezoelectric element bends in response to an applied voltage to said first and second electrodes which produces an electric field in the functionally gradient piezoelectric element;

(e) providing a plurality of power sources, each having first and second terminals and then connecting said first and second terminals to said first and second electrodes of one of said piezoelectric transducers for enabling fluid flow through a respective interior fluid compartment;

(f) energizing any one of said piezoelectric transducers to pump fluid from said fluid reservoir then through said inlet port of said interior fluid compartment in at least one of said pumps and then through said orifice in fluid communications therewith of said orifice manifold thereby forming an ejected droplet of fluid; and (g) positioning the receiver in proximity to said orifice manifold to receive said ejected droplet of fluid so as to form an image thereon.

2. The method recited in claim 1 wherein said step of energizing includes the step of applying a positive voltage to said first terminal and a negative voltage to said second terminal for pumping fluid out of said interior fluid compartment of one of said piezoelectric pumps.

3. The method recited in claim 1 wherein said step of energizing further includes the step of applying a negative voltage to said first terminal and a positive voltage to said second terminal for pumping fluid into said interior fluid compartment of one of said piezoelectric pumps.

4. The method recited in claim 1 wherein the step of providing a piezoelectric transducer further includes the step of providing a piezoelectric material selected from the group consisting of PZT, PLZT, LiNbO3, KnbO3, BaTiO3 and a mixture thereof.

5. The method recited in claim 1 wherein the step of arranging said piezoelectric transducers further includes the step of providing said first surface of said functionally gradient piezoelectric element in parallel with said second surface of said functionally gradient piezoelectric element.

6. The method recited in claim 5 wherein the step of arranging further includes poling said piezoelectric element in a direction perpendicular to the first and second surfaces, wherein the functionally gradient d-coefficient varies perpendicularly to the first and second surfaces and the first and second electrodes are disposed over the first and second surfaces.

* * * * *